US008247972B2

(12) United States Patent
Lapatovich et al.

(10) Patent No.: US 8,247,972 B2
(45) Date of Patent: Aug. 21, 2012

(54) CERAMIC DISCHARGE LAMP WITH INTEGRAL BURNER AND REFLECTOR

(75) Inventors: Walter P. Lapatovich, Boxford, MA (US); Jeffrey T. Neil, North Reading, MA (US)

(73) Assignee: Osram Sylvania Inc., Danvers, MA (US)

( * ) Notice: Subject to any disclaimer, the term of this patent is extended or adjusted under 35 U.S.C. 154(b) by 574 days.

(21) Appl. No.: 12/120,673

(22) Filed: May 15, 2008

(65) Prior Publication Data

US 2009/0284153 A1 Nov. 19, 2009

(51) Int. Cl.
*H01J 17/16* (2012.01)
*H01J 9/00* (2006.01)

(52) U.S. Cl. ..... 313/634; 313/318.11; 445/26

(58) Field of Classification Search ..... 313/634, 313/636–643, 318.11; 445/26, 27
See application file for complete search history.

(56) References Cited

U.S. PATENT DOCUMENTS

| | | | | |
|---|---|---|---|---|
| 5,721,465 | A | 2/1998 | Roberts | |
| 6,200,005 | B1 * | 3/2001 | Roberts et al. | 362/263 |
| 6,285,131 | B1 | 9/2001 | Kiss et al. | |
| 6,316,867 | B1 | 11/2001 | Roberts et al. | |
| 6,351,058 | B1 * | 2/2002 | Roberts | 313/113 |
| 6,597,087 | B2 | 7/2003 | Roberts et al. | |
| 6,602,104 | B1 | 8/2003 | Roberts | |
| 6,620,272 | B2 | 9/2003 | Zaslavsky et al. | |
| 7,045,960 | B2 | 5/2006 | Gunter | |
| 2005/0206319 | A1 * | 9/2005 | Botzer et al. | 313/634 |
| 2005/0213332 | A1 * | 9/2005 | Kendrick et al. | 362/296 |
| 2006/0186816 | A1 * | 8/2006 | Kurosawa | 313/635 |
| 2007/0069652 | A1 * | 3/2007 | Smith et al. | 313/634 |
| 2007/0120492 | A1 | 5/2007 | Selezneva et al. | |

FOREIGN PATENT DOCUMENTS

| | | | |
|---|---|---|---|
| EP | 1089321 | A1 | 4/2001 |
| EP | 1160919 | A1 | 12/2001 |
| JP | 2003/346723 | A | 12/2003 |
| WO | WO 98/53475 | A1 | 11/1998 |
| WO | WO 2004/023517 | A1 | 3/2004 |
| WO | WO 2005/088673 | A2 | 9/2005 |
| WO | WO 2008/049742 | A2 | 5/2008 |

OTHER PUBLICATIONS

U.S. Appl. No. 11/678,702, filed Feb. 26, 2007.
Abstract JP 2003/346723.

* cited by examiner

*Primary Examiner* — Bumsuk Won
(74) *Attorney, Agent, or Firm* — Robert F. Clark; Andrew Martin

(57) ABSTRACT

A ceramic discharge lamp and a method of making the lamp includes a ceramic discharge chamber with two concave parts that are attached to each other at a seam, and a ceramic reflector directly attached to an exterior surface of the discharge chamber at the seam, or directly attached to a ceramic capillary that is attached to one of the two concave parts. The lamp finds particular application where focused light is required, such as injection of light into a fiber optic device. The lamp can be very small and has an advantage that the discharge chamber is isolated from the reflective surfaces so that the optically active parts of the reflector are not covered with salt from the preferred metal halide lamp fill.

17 Claims, 6 Drawing Sheets

CERAMIC DISCHARGE LAMP WITH INTEGRAL BURNER AND REFLECTOR

BACKGROUND OF THE INVENTION

Miniature metal halide lamps have been on the market for some time, where the lamps are designed to be small and provide concentrated sources of light for inclusion into reflectors. The objective is to gather and focus or collimate the light for projection applications or injection into fiber optics for decorative or medical applications. Examples of this are well known in the art: vitreous silica high-intensity discharge (HID) lamps for automotive headlamps that project a beam for driving at night, and short-arc rare gas lamps for fiber illuminators. Recently the vitreous silica headlamps have been augmented with ceramic metal halide lamps of small dimensions for similar purposes as taught by Guenther U.S. Pat. No. 7,045,960; Wijenberg et. al. WO2004/023517 A1; Hendricx et. al. WO2005/088673 A2; and Selezneva et. al. US 2007/0120492 A1. The lamps may or may not contain mercury. An example of a lamp used for medical applications, namely fiber optic illuminators for surgical applications, is the Cermax® lamp, containing only a high pressure Xe gas filling.

Attempts to combine the integral short arc features of the Cermax® lamp with a filling that remains unobtrusive during operation have been less than satisfactory. Lamp operation in saturated regimes where salts are free to condense at cold spots almost guarantees the salts will coat the windows and occlude the light, filter and change the color, likely in a random and unwanted fashion.

There is a need for a more efficacious short-arc lamp in the 10-50 W range that can produce focused light, but that uses the more efficient light generation potential of metal halide fills.

SUMMARY OF THE INVENTION

An object of the present invention is to provide a novel ceramic discharge lamp and method in which the discharge chamber and reflector are assembled as one piece where the discharge chamber is separated from the reflector active area by a wall, so that the discharge fill material is isolated from the reflective surfaces and lens (if any) and the optically active area is not covered with a salt film.

A further object of the present invention is to provide a novel metal halide lamp and method of making the lamp in which a ceramic discharge chamber with two concave parts are attached to each other at a seam, and a ceramic reflector is directly attached to an exterior surface of the discharge chamber at the seam, or directly attached to a ceramic capillary that is attached to one of the two concave parts. Preferably, the concave parts are generally hemispherical and are attached to each other at an equator.

A yet further objective of the present invention is to provide an integrated metal halide lamp where the discharge chamber and reflector are arranged to focus light from the arc at the second focus of an ellipse for illumination of and injection into a fiber optics bundle.

A still further objective of the present invention is to achieve these goals at higher power loading since the reflector acts a heat sink for the discharge chamber.

These and other objects and advantages of the invention will be apparent to those of skill in the art of the present invention after consideration of the following drawings and description of preferred embodiments.

DETAILED DESCRIPTION OF THE INVENTION

Figure 1:
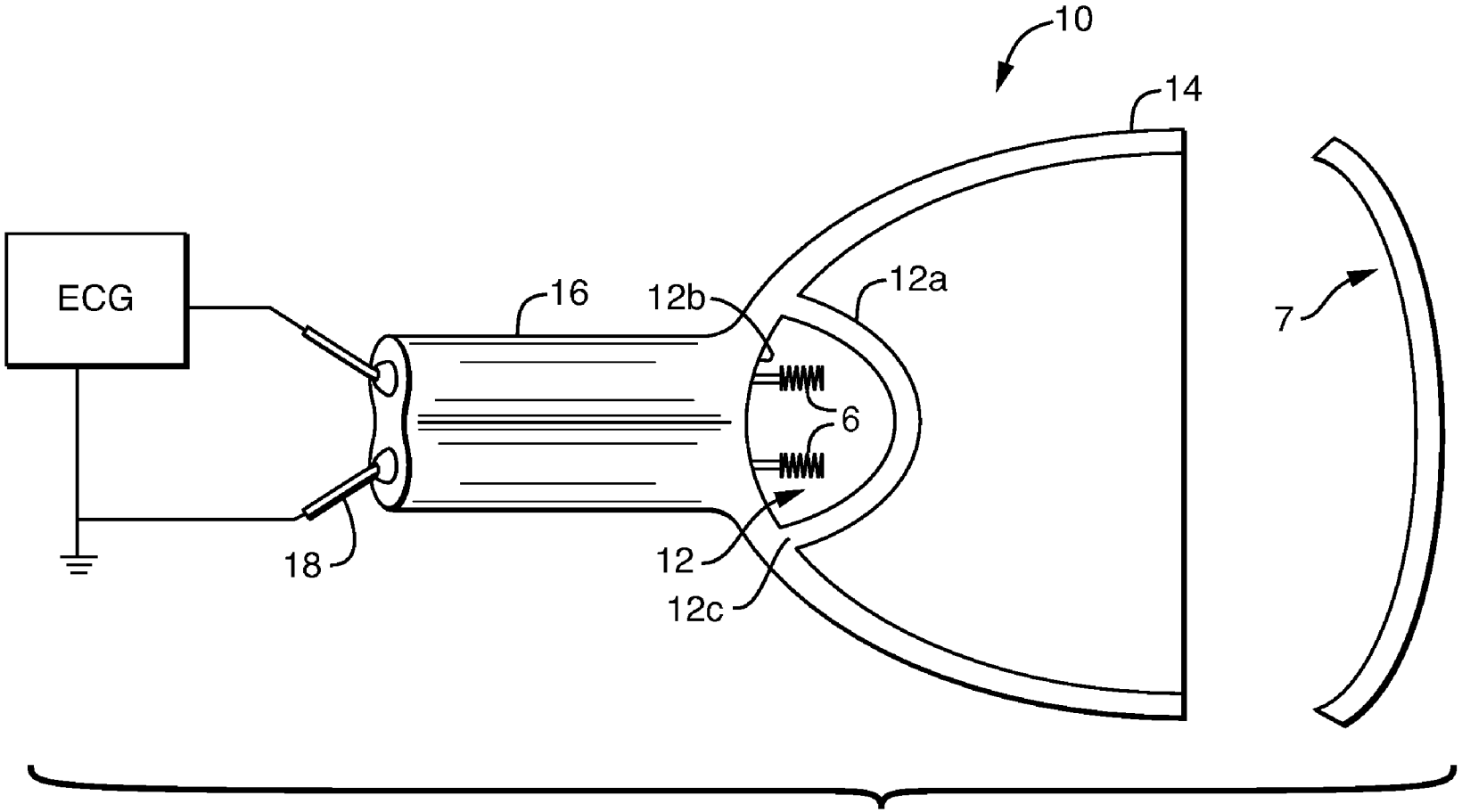
FIG. 1 is a pictorial representation of a first embodiment of the lamp of the present invention.

The present invention pertains to lamps with ceramic discharge vessels, in particular ceramic metal halide lamps, intended for, but not limited to, applications where focused light is required. Such applications include injection of light into fiber optic devices for decorative lighting, accent lighting, medical endoscopic applications, injecting light into film gates, LCD and DLP® (Digital Light Projection devices, Trademark of Texas Instruments), microscopes, and other technical applications.

In one embodiment, the present invention provides a ceramic discharge lamp with enclosed discharge fill material, preferably a metal halide fill chemistry, to produce useful light. Such preferred metal halide chemistry can be, but is not limited to, a blend of rare earth salts such as halides of Dy, Tm, Ho, with halides of an alkali such as Na and an alkaline earth such as Ca. Iodides are the preferred halides. Other chemistries may be Ce or Pr halides. The lamp may also contain metallic Hg. The lamp also preferably contains an inert buffer gas to permit lamp starting. The gas may be Ar, Kr, Ne or Xe or mixtures thereof, and may be in the cold fill pressure range of 0.004 bar to 15 bar depending on whether the lamp is intended for slow warm-up or more rapid warm-up as in an automotive D lamp, typically containing around 10 bar of Xe (cold fill). Typical fills might include 0.13 bar Ar. Although a metal halide chemistry is preferred, it would be clear to one of skill in the art that other types of fills would be also useful in the ceramic discharge lamp of this invention.

The discharge chamber of the burner and the reflector are assembled into one integral piece, with the discharge chamber being separated from the reflector active area by a wall. The discharge chamber is thus enclosed and comprises a much smaller volume than the reflector itself. This has the advantage of isolating the discharge fill material away from the reflective surfaces and lens (if any) so that the optically active area is never covered by salt films. Optically the lamp behaves as a non-integrated lamp in that the source of light is maintained at the focus of the reflector. Thermally and structurally it is novel. The reactivity and salt occlusion issues are decoupled in the instant design. The comparatively larger reflector can act as a thermal radiator and keep the discharge chamber cooler than ordinarily achieved. This may allow for operation at elevated wall loadings and higher vapor pressure of the fill additives to produce more and better color light. Operation at high wall loadings (>32 W/cm$^2$) is preferred for some rare earth based chemistries.

The reflector may be an optic of revolution symmetric around the optic axis. It may also be molded in a non-symmetric shape such as is required for maximum energy transport consistent with principles of non-imaging optics and the laws of thermodynamics. For practical purposes, an ellipse of revolution is considered as the preferred mode.

The lamp provides an integrated ceramic discharge lamp where the discharge chamber and reflector are arranged to focus light from the arc at the second focus of the ellipse for illumination of and injection into a fiber optics bundle. The lamp confines the fill in the discharge chamber away from the optically active elements in the reflector. Further, the lamp achieves these goals at higher power loading since the reflector acts a heat sink for the discharge volume. The present invention allows the discharge chamber or burner to be small and confined away from the reflector surface, yet in intimate thermal contact with the reflector itself so that the reflector provides a heat sink.

Figure 6:
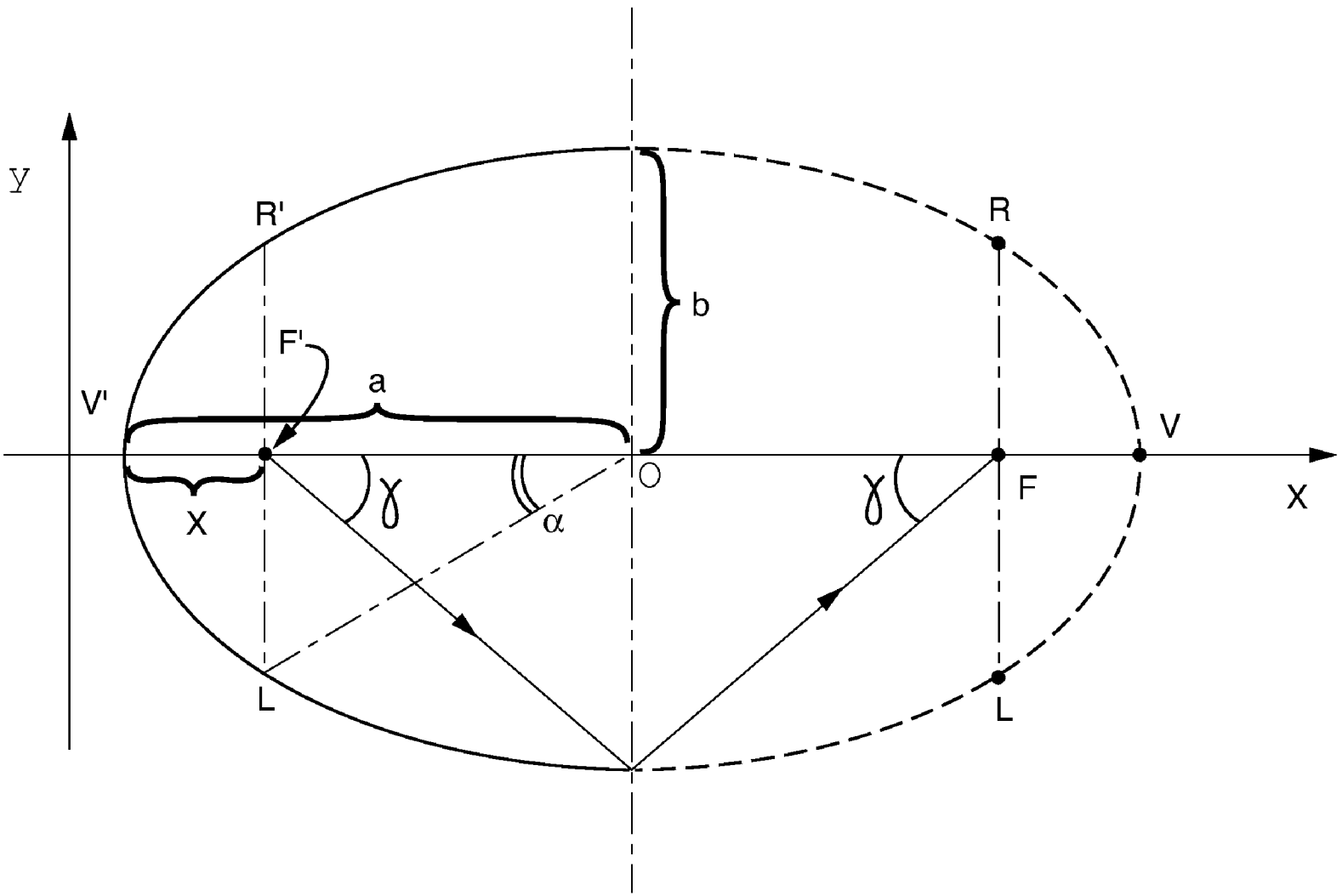
FIG. 6 is a pictorial representation of foci and dimensions of an elliptical reflector in an embodiment of the lamp of the present invention.

A more complete description is afforded by inspection of the drawings. FIG. 1 shows a first embodiment of the lamp of the present invention. The geometry of an elliptical reflector suitable for the present invention is shown in FIG. 6. The lamp 10 includes a ceramic discharge chamber 12 that is positioned so the arc is at focus F' of ceramic reflector 14. The reflector 14 collects the light from the discharge chamber 12 and focuses it to F. A ceramic capillary 16 is provided and includes two electrodes 18 that extend into the discharge chamber so that an imaginary line between the tips 6 of the electrodes intersects the focus F'. The discharge chamber 12 includes two concave parts 12*a* and 12*b* (right and left parts of the chamber 12 in FIG. 1) attached to each other at a seam 12*c*, where the ceramic reflector 14 is directly attached to an exterior surface of the discharge chamber 12 at the seam 12*c*, such as shown in FIG. 1. Preferably, the concave parts are generally hemispherical. Generally hemispherical means that the parts are generally dome-shaped or parts thereof that are not necessarily round when joined, and providing a suitable interior space for operation of the arc. A preferred ceramic for the ceramic discharge chamber and the ceramic reflector is polycrystalline alumina.

The electrodes 18 are sealed into the discharge chamber through the capillaries 16 and are substantially in line with, but offset from, the optic axis of the reflector. These electrodes assemblies are generally constructed with tungsten tips 6 and may include other refractory metal parts including molybdenum and niobium electrical in-leads welded to the W tips. The electrodes serve to bring electricity into the volume of the burner body. The current passing through the lamps and voltage developed across the electrodes delivers power to the gas which heats the burner, vaporizes the chemical fill and energizes the vapors into a plasma state to produce useful radiations, preferably visible light. The electrode structures are sealed using glassy/crystalline frits well known in the art. An optional lens 7 may be attached to the open end of the reflector.

As will be explained below, the discharge chamber and reflector are fabricated as two pieces, joined together in the green state (such as the 2 piece bulgy known in the art, e.g. U.S. Pat. No. 6,620,272 by Zaslavsky et. al.) and sintered to full density.

Figure 2:
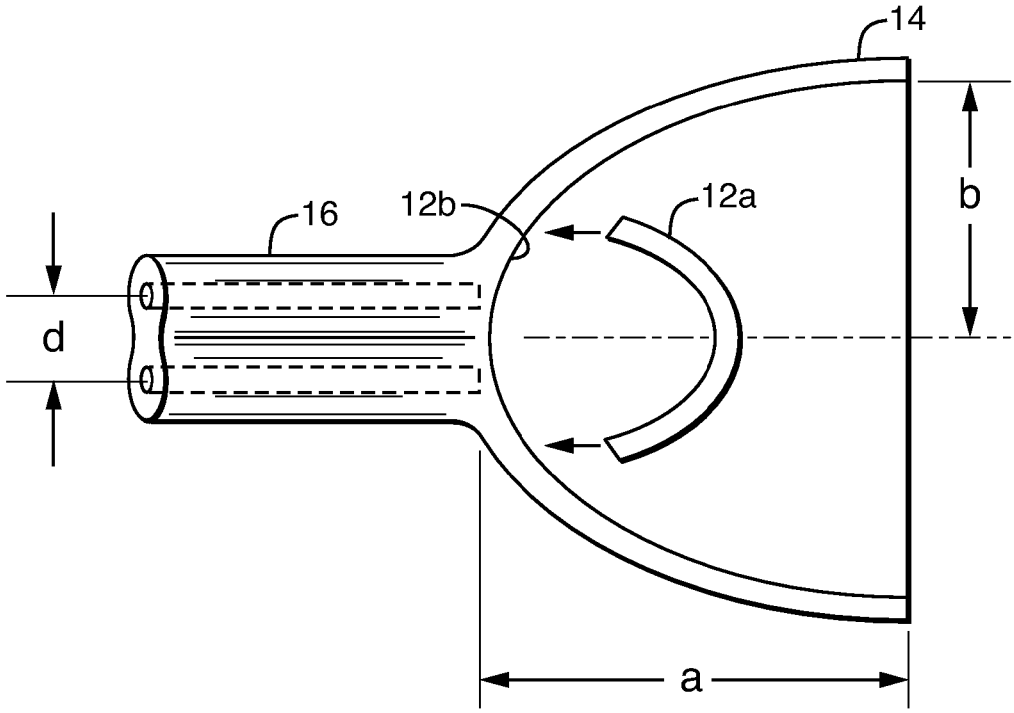
FIG. 2 shows a method of assembly of the lamp of the first embodiment.

In a first method of assembly shown in FIG. 2, a first ceramic piece (Part 1) includes the reflector 14, a first one of the concave parts 12*b* (the left interior end of the reflector shape in FIG. 2) and the capillary 16, and a second ceramic piece (Part 2) includes a second one of the concave parts 12*a*. The components can be assembled by chemical joining using a solvent to partially dissolve the binder phase in the pieces or by thermal joining where a heated gas jet is used to soften the two faces to be joined just before assembly.

Figure 3:
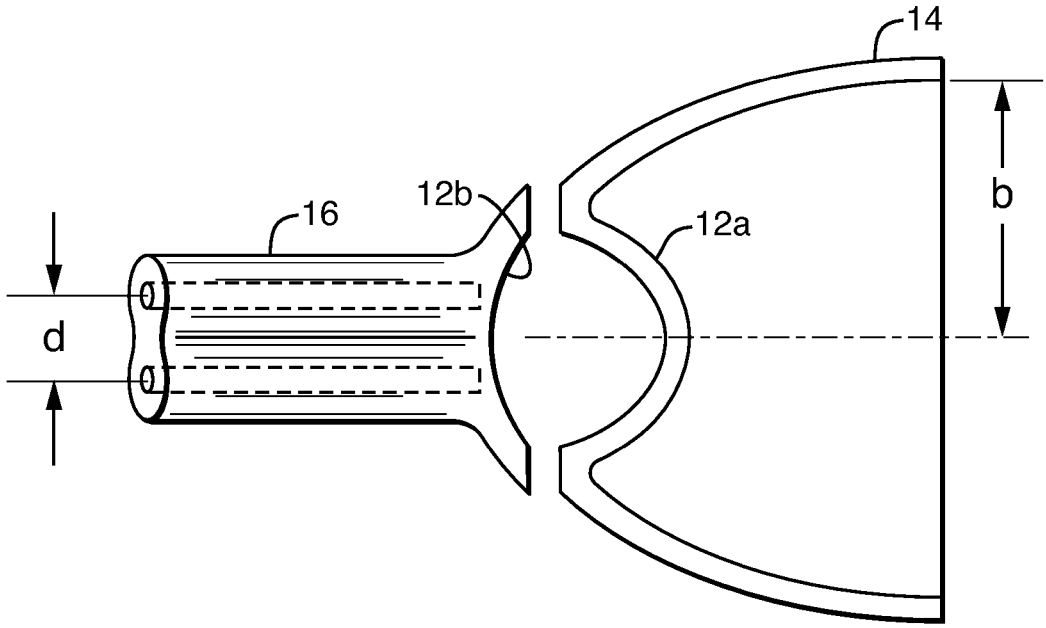
FIG. 3 shows a second method of assembly of the lamp of the first embodiment.

In a second method of assembly shown in FIG. 3, a first ceramic piece (Part 1) includes a first one of the concave parts 12*b* and the capillary 16, and a second ceramic piece (Part 2) includes the reflector 14 and a second one of the concave parts 12*a*. As in the first method, the components can be assembled by chemical joining using a solvent to partially dissolve the binder phase in the pieces or by thermal joining where a heated gas jet is used to soften the two faces to be joined just before assembly. The second method shown in FIG. 3 is preferred for thermal joining since it allows easier access to the surfaces to be joined by the heat source.

Figure 4:
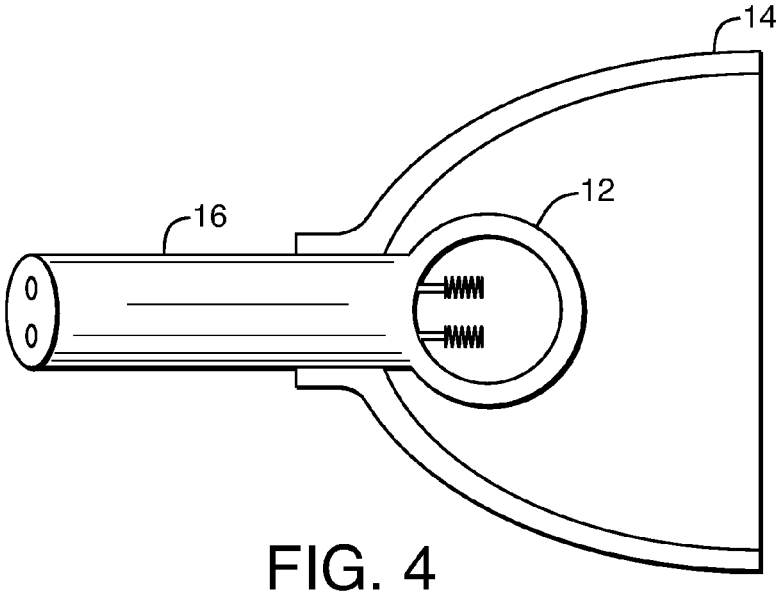
FIG. 4 is a pictorial representation of a second embodiment of the lamp of the present invention.
Figure 5A:
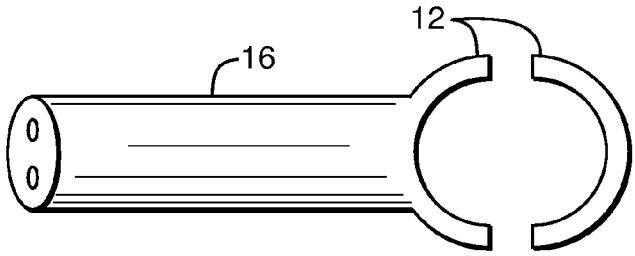
FIGS. 5*a* and 5*b* show a method of assembly of the lamp of the second embodiment.
Figure 5B:
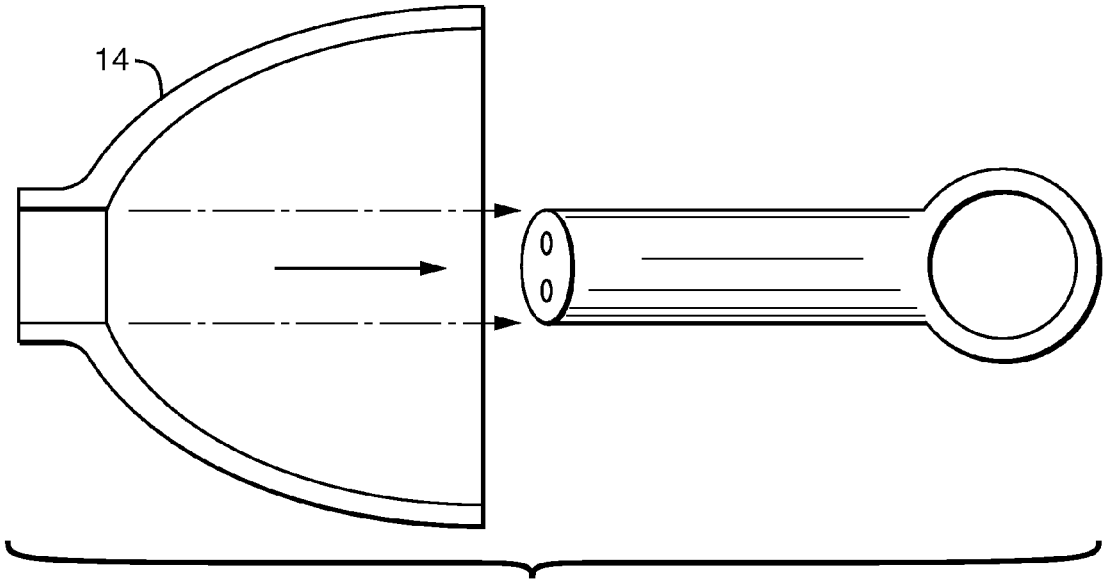

If the desired discharge cavity volume and placement at the focal point of the reflector are not compatible with the shape shown in FIG. 1 (for example, operation at lower wattage requires a smaller discharge volume), the discharge cavity 12 can be produced as a small isolated cavity positioned further inside the reflector 14 as shown in the second embodiment of FIG. 4. This allows maximum flexibility in controlling discharge cavity volume and focal position. This configuration could be produced by using three ceramic shapes as shown in FIGS. 5*a, b* and joined together to form the final component. As shown in FIG. 5*a*, the capillary component may first be joined to the portion completing the closure of the discharge cavity using thermal or chemical joining. The reflector could then be slid onto the capillary portion as shown in FIG. 5*b*. The bonding of the reflector to the capillary portion could be done in the green state by thermal or chemical joining, in the pre-fired state using an interference fitting method, or after final sintering using a high temperature frit before the filling of the arc tube and electrode sealing. While a cylindrical capillary is depicted in FIG. 4, the invention is not limited to this geometry. For example, the capillary regions may be flattened or have more of a rectangular cross section.

It is another beneficial feature of the instant invention that the integral reflector co-joined to the discharge volume functions as a heat dissipating structure permitting the seal regions of the electrode to operate cooler. In such a case it may be possible to operate the structures in open air for prolonged times without the need for outer jacket enclosures that are discussed below.

Since many fiber optics bundles or single mode fibers have numerical apertures on the order of 0.64, this means the half angle of acceptance is approximately 40° with respect to the optic axis (this will depend on the particular fiber and relative indicies of refraction between core and cladding. See for example: C. Hentschel, Fiber Optics Handbook, 2$^{nd}$. Edition, Hewlett Packard, Fed. Rep. Germany, 1988). The full angle is about 80° and any light outside of this collection angle is lost to the fiber and can be deleterious as it does not propagate into the fiber but is dissipated as heat at the fiber entrance port. If the fiber is polymeric, this can cause melting of the fiber. Glass fiber and bundles are best used when matching cannot be achieved well.

FIG. 6 shows the focal points and relationships with the physical dimensions of the reflector. The shape of the reflector body is nominally an ellipse of revolution whose cross section through the optic axis and foci is describable by:

$$\frac{x^2}{a^2} + \frac{y^2}{b^2} = 1 \quad (1)$$

With eccentricity, e.

$$e = \frac{\sqrt{a^2 - b^2}}{a} \quad (2)$$

It is well known that the latus rectum, L'R', has line length (see FIG. 6), $$L'R' = 2\frac{b^2}{a} \quad (3)$$

And that the distance from the center, O, to the focus F' is $$OF' = \sqrt{a^2 - b^2} \quad (4)$$

One can construct then relationships between the focal angle, γ, and the dimensions of the ellipse. This is necessary so the complementary focus, F, and focal angle can be matched to the acceptance angle of the fiber optic bundle as discussed above. An application of trigonometry shows that, $$\tan\alpha = \frac{F'L'}{a - x} = \frac{\text{latus_rectum}/2}{a - x} = \frac{\frac{b^2}{a}}{OF'} = \frac{\frac{b^2}{a}}{\sqrt{a^2 - b^2}}, , \quad (5)$$

and that $$\tan\gamma = \frac{b}{\sqrt{a^2 - b^2}}. \quad (6)$$

Thus in practice, the output diameter of the reflector is chosen. If this is to match to a fiber optic bundle of known numerical aperture, NA, then the dimension, a, is determined by equation 6 above. For example, NA=0.64 (typical for FO bundles), with the entrance of the fiber optic placed at complementary focus, F. NA=sin γ≅0.64, implies that γ=39.8°. So substituting this value in (6) gives the relationship $$0.83 = \frac{b}{\sqrt{a^2 - b^2}}.$$

For this case, a reflector with a diameter 2b=50.8 mm (about 2 inches), would have a depth, a=39.77 mm; and the arc would be positioned at F', where x is measured from the rear of the ellipse, $$x = a - \sqrt{a^2 - b^2} = 9.17 \text{ mm} \quad (7).$$

These dimensions refer to the reflective part of the ellipse. The outer diameter of the actual object may include twice the wall thickness of the ceramic. This wall thickness may range from 0.4 to 1.5 mm with a preferred average value of 0.9 mm.

Figure 7:
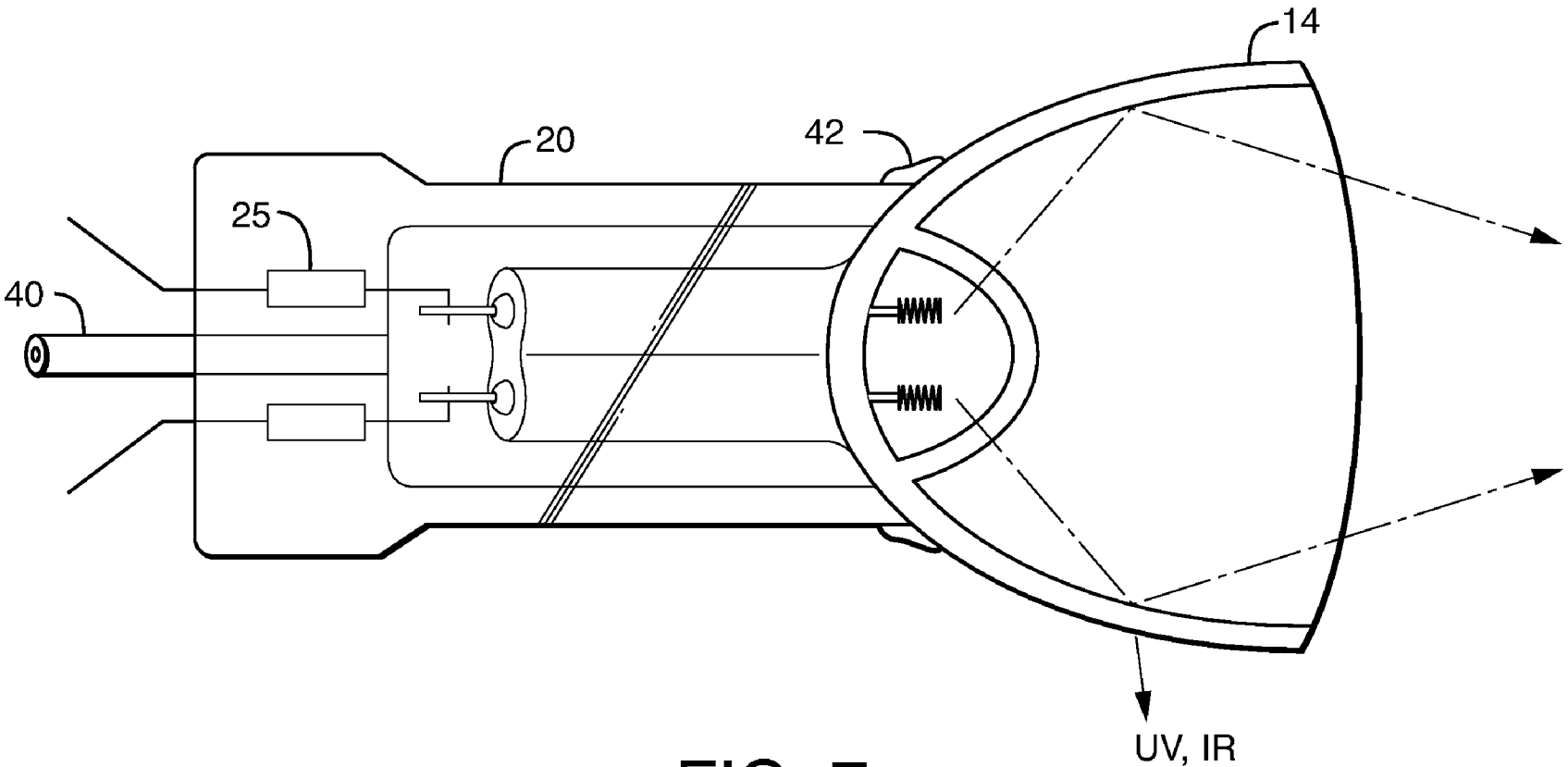
FIG. 7 is a pictorial representation of the lamp of the present invention with a protective cover without a lens.

With reference now to FIG. 7, the reflector 14 may have coatings applied to the optically active surfaces to enhance spectral reflectivity. These coatings may be silver, silver with an overcoat of aluminum oxide, or other highly reflective metals such a chromium could also be used. An interference coating could also be used which is highly reflective in the visible (380-780 nm) and transmissive in the IR or UV. Such a coating is useful for fiber optic applications since it reduces the optical burden at the fiber entrance port of harmful wavelengths. Too much UV in the focused beam can cause degradation in polymer bundles. Note that a useful feature of the present invention is that the discharge chamber and reactive salts are physically prevented from contacting the coated areas.

Figure 8:
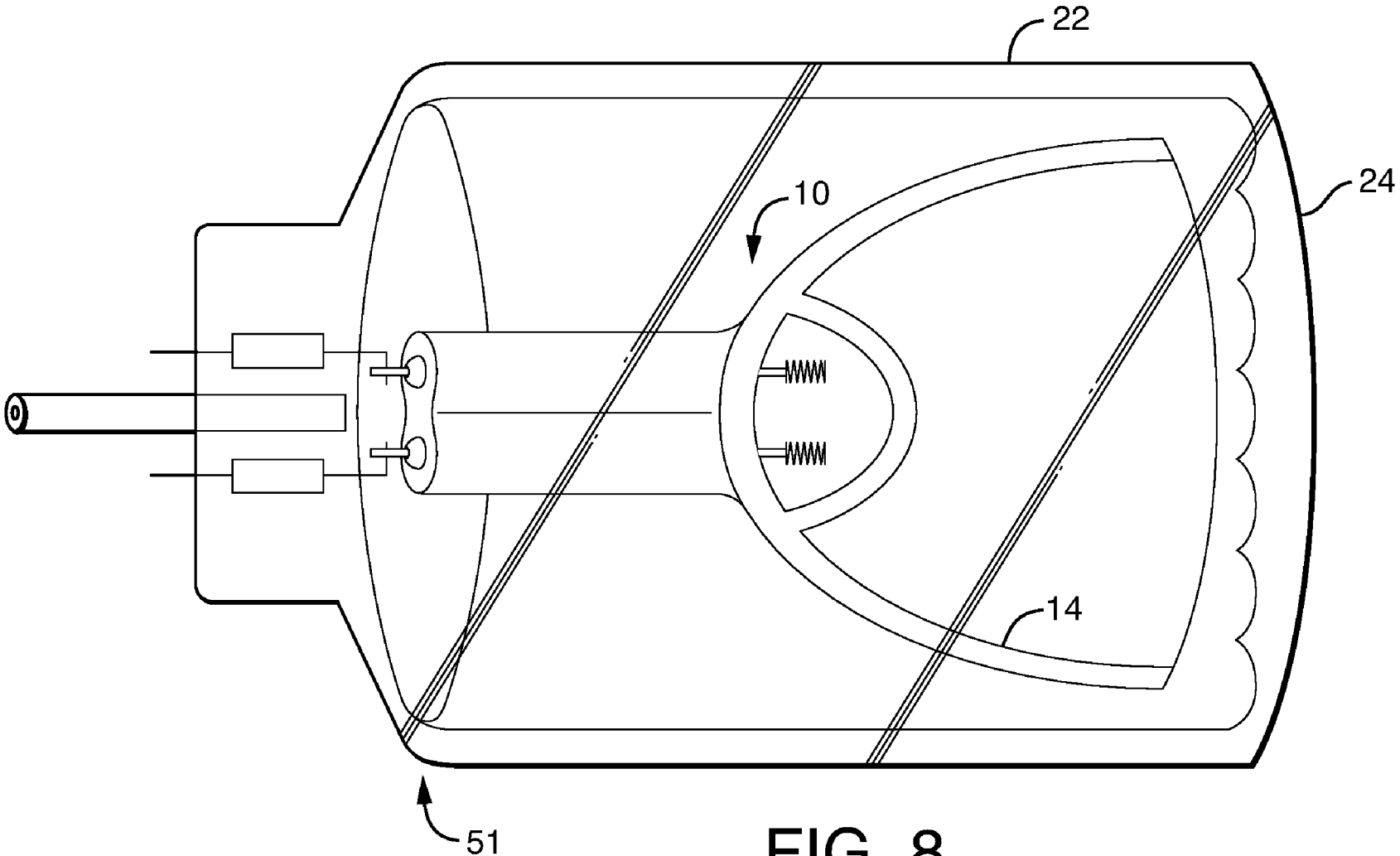
FIG. 8 is a pictorial representation of the lamp of the present invention with a protective cover with a lens.

With further reference to FIG. 7 and also to FIG. 8, the present invention may include means to protect the sealing portion of the electrode structures from oxidation. A first method is to weld oxidation resistant metal to the niobium wire of the electrode structure and overcoat with a low melting temperature frit or ceramic cement such as is known in the art (not shown). A second method shown in FIG. 7 is to seal a portion of quartz tubing 20 to an exterior non-reflective surface of the reflector 14 with frit 42 and then press closed with Mo foil seals 25 as is commonly done with quartz or hardglass outer jackets. A further approach shown in FIG. 8 is to enclose the entire assembly into an outer jacket (OJ) 22 for press sealing, the dome end of which contains lenticular elements 24 to assist in controlling the light output. The outer jacket may include an inert gas to limit Na loss or regulate lamp temperature. The location of the lamp 10 within the outer jacket 22 may be established by setting the inner diameter of the outer jacket to about the same as (just slightly larger than) the outermost diameter of the reflector 14. A flame seal 51 may be used to join major sections of the outer jacket. In either event, suitable pump-out tubing 40 may be provided from the base of the capillary.

The excitation modes for such a lamp could be 40-100 Hz AC with a simple inductive ballast, electronic excitation with switched DC, and any of a number of methods well-known in the art. (See, ECG in FIG. 1) Any type of acoustic modulation may be superimposed on the waveform for the benefit of color stability or optical flux enhancement. With parallel electrode feed-throughs, it is also possible to utilize the electrode structures as a balanced twin-line transmission line for the transmission of high frequency power into the lamp through the electrodes. The exciter could then be a small high frequency source in the MHz to GHz range. It is believed that a lamp so fabricated and operated would last thousands of hours consistent with good design practice of ceramic lamp technology.

While embodiments of the present invention have been described in the foregoing specification and drawings, it is to be understood that the present invention is defined by the following claims when read in light of the specification and drawings.

We claim:

1. A ceramic discharge lamp comprising:

a ceramic discharge chamber with two concave parts attached to each other at a seam, the discharge chamber enclosing a discharge fill material; and a ceramic reflector directly attached to an exterior surface of said discharge chamber at the seam.

2. The lamp of claim 1, further comprising a ceramic capillary directly attached to a first of said two concave parts and two electrodes extending through said capillary into said discharge chamber, wherein an imaginary line between ends of said electrodes in said discharge chamber intersects a focus of said reflector.

3. The lamp of claim 2, further comprising an outer jacket around said capillary, said outer jacket being directly attached to a non-reflective part of said reflector with a frit seal, said two electrodes extending through said outer jacket.

4. The lamp of claim 2, further comprising an outer jacket completely surrounding said capillary, said reflector and said discharge chamber, said outer jacket having a lens element at an opening of said reflector, wherein said two electrodes extend through said outer jacket and wherein an inner diameter of said outer jacket is no less than an outermost diameter of said reflector.

5. The lamp of claim 1, further comprising a lens attached to the reflector.

6. The lamp of claim 1, wherein the concave parts are generally hemispherical.

7. The lamp of claim 1, wherein said lamp comprises a first ceramic piece that includes a first of said two concave parts, and a second ceramic piece that includes said ceramic reflector and a second of said two concave parts, said first and second ceramic pieces being directly attached to each other at the seam.

8. The lamp of claim 7, further comprising a ceramic capillary directly attached to said first of said two concave parts and two electrodes extending through said capillary into said discharge chamber, wherein an imaginary line between ends of said electrodes in said discharge chamber intersects a focus of said reflector.

9. The lamp of claim 7, further comprising a ceramic capillary directly attached to said second of said two concave parts and two electrodes extending through said capillary into said discharge chamber, wherein an imaginary line between ends of said electrodes in said discharge chamber intersects a focus of said reflector.

10. The lamp of claim 1, further comprising a lens coupled to one of the concave parts and the lens located exterior to the discharge chamber.

11. The lamp of claim 1, further comprising a lens coupled to one of the concave parts and providing a second exterior chamber.

12. The lamp of claim 1, wherein the ceramic reflector directly attaches to the exterior surface and an interior surface of said discharge chamber.

13. The lamp of claim 1, wherein the ceramic reflector is directly attached to the exterior surface of said discharge chamber beginning at the seam and extends along a concave surface of one of the concave parts.

14. The lamp of claim 1, wherein the two concave parts separate the discharge chamber from the reflector.

15. The lamp of claim 1, wherein the reflector is positioned to focus light from the discharge chamber.

16. A method of making a ceramic discharge lamp comprising the steps of:

making a ceramic discharge chamber by attaching two concave parts to each other at a seam; and directly attaching a ceramic reflector to an exterior surface of the discharge chamber at the seam.

17. The method of claim 16, further comprising steps of directly attaching a ceramic capillary to a first of said two concave parts and extending two electrodes through said capillary into said discharge chamber, wherein an imaginary line between ends of said electrodes in said discharge chamber intersects a focus of said reflector.

* * * * *